United States Patent [19]

Reyes

[11] 4,274,386

[45] Jun. 23, 1981

[54] TURBO PLATE VAPORIZER

[76] Inventor: Jose Reyes, 1427 5th Ave., Bay Shore, N.Y. 11706

[21] Appl. No.: 69,255

[22] Filed: Aug. 24, 1979

[51] Int. Cl.[3] ..... F02M 29/00

[52] U.S. Cl. ..... 123/591; 123/590

[58] Field of Search ..... 48/180 R, 180 M; 123/590, 591, 592

[56] References Cited

U.S. PATENT DOCUMENTS

| | | | |
|---|---|---|---|
| 1,446,086 | 2/1923 | Green | 48/180 R |
| 3,077,391 | 2/1963 | Guffra | 48/180 R |
| 3,393,984 | 7/1968 | Wisman | 123/590 |
| 3,942,500 | 3/1976 | Koehm | 48/180 R |
| 4,015,574 | 4/1977 | Hanff | 123/590 |

FOREIGN PATENT DOCUMENTS

| | | | |
|---|---|---|---|
| 110174 | 4/1940 | Australia | 48/180 R |
| 533264 | 11/1954 | Belgium | 48/180 R |
| 774835 | 6/1934 | France | 48/180 R |
| 1213642 | 4/1960 | France | 123/590 |
| 51602 | 3/1920 | Sweden | 48/180 R |

*Primary Examiner*—Ronald H. Lazarus
*Attorney, Agent, or Firm*—Burton S. Heiko

[57] ABSTRACT

A single, relatively thin, plate with no movable parts, easily inserted between the bottom of the carburetor and the top of the intake manifold of vehicles using internal combustion engines without fuel injection systems, which plate has a plurality of wedge shaped collectors directed in a counterclockwise direction, the shoulders of one side of the wedge like collector helping to break up the fuel mixture into smaller parts with the two sides of the wedge like shaped collector forming a cup like funnel ending in the apex of the wedge like collector which points of the wedge shaped collectors form a smaller inner circumference than the outer circumference at the base of the wedges helping to funnel the liquid mixture collected into the main steam of the air current causing both greater atomization and vaporization thus increasing fuel economy while decreasing exhaust pollution.

4 Claims, 5 Drawing Figures

TURBO PLATE VAPORIZER

BACKGROUND OF THE INVENTION a. Field of the Invention

We have been accustomed in this country to use cheap energy without thought of ways of using less by improving the various devices and machinery we normally run. One of the areas that has now come to the fore is the better and improved fuel mixture both to increase efficiency and decrease pollutants. In this area the easiest way to to effect a great increase in economy with a small expenditure of money is to place some sort of device between the carburetor and the intake manifold of a motor vehicle. Such a device usually requires little, if any, machining or adjustment and is a relatively easy way to effect savings without great changes in the carburetor and intake manifold. This, of course, has to do with vehicles without fuel injection systems or any measured amounts of fuel and air being injected into cylinders simultaneously. While such devices have not proved popular before, chiefly, because of cheap gasoline, it is expected that with older and heavier cars it will become necessary to bring some sort of economy to such flagrant gas burners. Although, there is now no government regulation requiring older cars to maintain some sort of gas economy, the future may require such devices in order to merely run such vehicles.

b. Description of the Prior Art

Numerous patents have been granted attempting to improve on the usual carburetor whether 1, 2 or 4 barrelled by inserting various devices between the carburetor and the intake manifold. Interest in these devices has never been very strong even after the 1974 gas crisis. But with the advent of the present fuel shortage interest has awakened again and is now forcing people to consider energy conservation in every purchase and repair they make. We are becoming aware, especially in this country, that energy of all types but especially gasoline was used in motor vehicles without any thought of their cost and up until recently the efficiency of the gasoline motor was far secondary to the power generated and the style and size of both the car and its engine. Since the latest fuel crunch people have become conscious of gasoline consumption and its relative efficiency as compared to smaller and lighter models. The market for larger cars has become depressed and large cars are fast becoming "White" "Elephants" too costly to run using their present unimproved fuel systems. New and costly attempts are now being made to change from gasoline to other forms of power such as battery electricity and even liquid gas. But the installation of a motor capable of burning both propane and ordinary gasoline is very expensive and not worth the effort in older cars. While the use of electric motive power has only a very limited range as yet in an area used to the casual longer ranges of the average car and driver.

But more and more as in other areas reductions in costs and increases in efficiency are being sought and found. The automobile carburetor and fuel system is one of those areas where costs are being reduced by using more efficient means to burn the fuel without going into extravagant costs and new expensive devices.

And devices to make the larger car as efficient to run as a smaller car is not only an investment in saving money but, also, in preserving safety and reducing maintenance as well. Safety statistics show that accidents between smaller vehicles and trucks show a much larger death rate than similar accidents between larger cars and trucks. And this is occuring while the trucks are getting larger and the cars smaller. So, too, is the result of repairing larger as compared to smaller cars. The smaller car when involved in an accident involve more of the body than the larger car and correspondingly costs more to repair than the larger car where discrete parts of the body can be more easily replaced than the smaller car.

Activity has been evidenced over the years in this area by various patents granted with a trend toward easily installed devices with no moving parts and no servicing required. Thus by the nature of these devices the system either better atomizes and or vaporizes the fuel air mixture leading to greater efficiency and more economy.

Devices of this type are those illustrated by the following U.S. Pat. Nos. 1,868,902; 1,937,875; 3,077,391; 3,437,467; 3,938,967; and 4,015,574. These are of the nature of some ribbed structure, either with openings in the center or sides with some adding air either at the top, bottom or sides aimed primarily at increasing the turbulence of the fuel mixture. But these devices do not shut off liquid mixtures sliding down the walls of the carburetor and manifold and thus some mixture is never properly mixed at any time.

Another, U.S. Pat. No. 2,685,504 teaches both the use of no turbulence and using the heat of the engine block to increase vaporization by having a series of metal strips deep into the intake manifold thus absorping the heat of the engine block to increase vaporization.

Another, U.S. Pat. No. 3,393,984 teaches the use of a Teflon like covered plate that is not wettable and causes the liquid globules to fragment and thus better atomizes the fuel mixture. The so called homogenizer plates which are really vanes or blades are not crucial to the invention. But the overall structure of the invention does not allow the fuel mixture to slide down the walls unchecked.

Another U.S. Pat. No. 4,092,966, uses a plate with a sleeve attached to the plate which sleeve hangs into the intake manifold and which sleeve has lands and grooves helping to break up the fuel mixture.

These patents are the most pertinent to this area of development and show a continuing line of development in this field to further aid in atomizing and vaporizing the fuel mixture. None has received any acceptance so far as is known and acceptance probably is dependent on the realization by the public that there really is a fuel shortage.

SUMMARY OF THE INVENTION

This invention is an improvement over those patents in the past which allowed liquid fuel mixture to slide down the sides of the carburetor unchecked and undirected while not providing a plate of sufficient design to direct and hold the fuel mixture to the center of the air stream while maintaining sufficient turbulence to both greater atomize and vaporize the fuel air mixture.

Applicant's device consists of a plate with openings in it depending on whether it is a 1, 2 or 4 barrelled, each opening in the plate having the same outside diameter as that leading from the carburetor, with a plurality of triangular like shaped vanes set in a counterclockwise direction helping to direct the fuel air mixture in that direction, first against the long side of the triangularly shaped fin, with that side first rising as a small shoulder and then dipping down and toward the center of the opening at the point of the triangle which shoulder helps break up the swirling mixture at like points along all the triangularly shaped vanes, and then curving toward the point of the vane with the opposite side of the vane curving in the same direction toward the point of the vane forming a cup or funnel directing the liquid part of the fuel air mixture not already vaporized to being further atomized and then vaporized as it is sucked into the air stream toward the center of the opening in the plate at the points of the plurality of vanes having a smaller internal circumference than at the outside circumference of the opening leading to the plate thus further helping to increase the pull of the air increasing the vaporization of the mixture at that point giving a higher degree of burning efficiency while reducing the pollutants coming from such motors using such a device.

It is a principal object of this invention to provide a simple, single, relatively thin plate, that helps increase the turbulence of the mixture while at the same time funneling any still liquid part of the mixture toward the center of the opening in the plate helping to further mix the mixture and aid in greater atomization and vaporization.

It is another object of the invention to design a simple plate, easily stamped out, relatively inexpensive to purchase and install, which greatly adds to the efficiency of the motor.

BRIEF REVIEW OF THE DRAWINGS

DETAILED DESCRIPTION OF THE PREFERRED EMBODIMENTS

While the invention will be described in connection with the preferred embodiments, it will be understood that it is not intended to limit the invention to these embodiments. On the contrary, it is intended to cover all alternatives, modifications and equivalents as may be included within the spirit and scope of of the appended claims. It is also intended to embrace all equivalents and substitutes within the broad scope of this invention.

Figure 1:
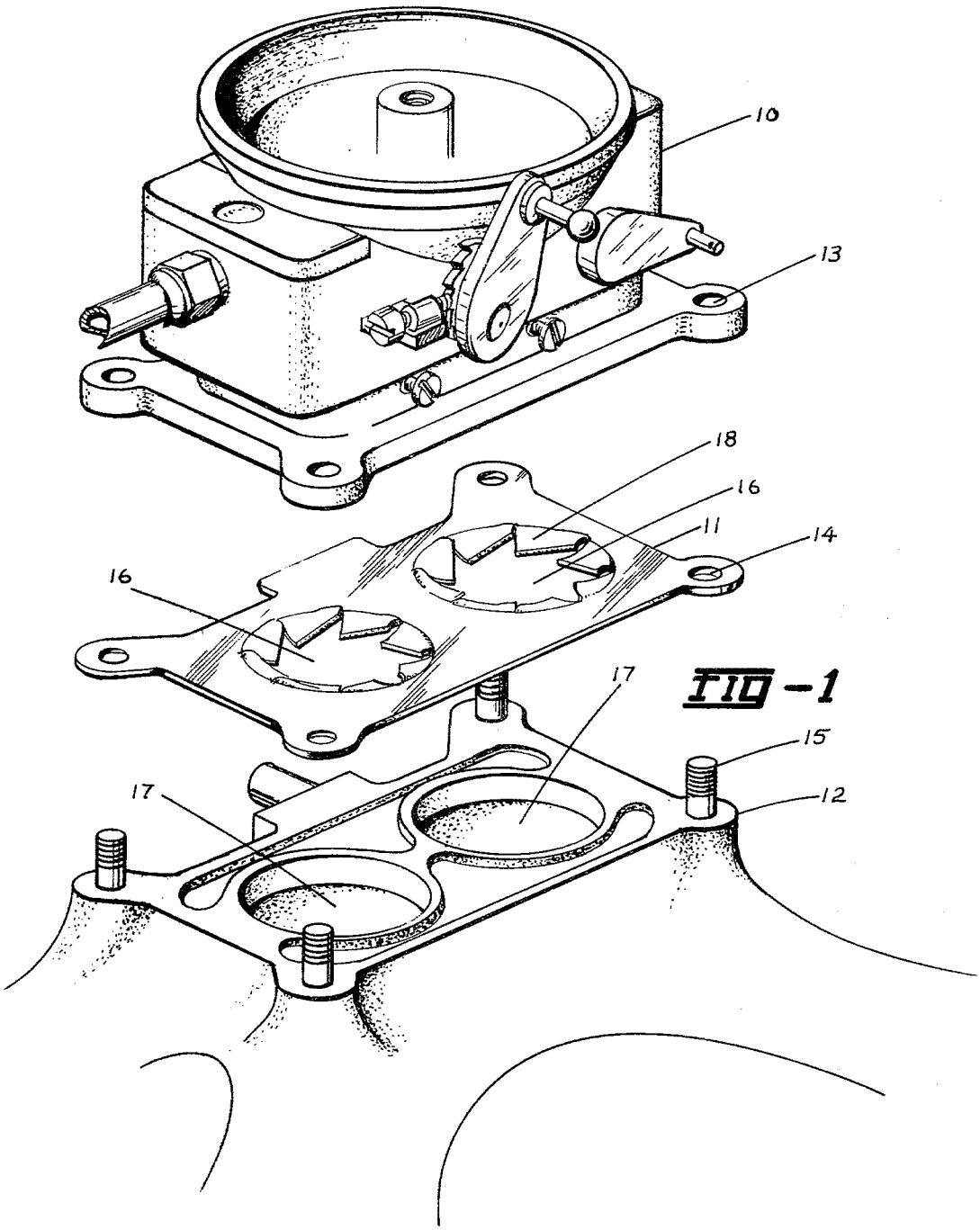
FIG. 1 is an isometric drawing of the invention herein showing its position below the carburetor and fitting above the intake manifold and fastened to it.

In the preferred embodiment the placing of the Turbo Plate Vaporizer is shown in FIG. 1, with the plate, Number 11, placed between the bottom of the carburetor, Number 10, and the base of the intake manifold, Number 12. The plate can be fastened by the same bolts and holes, Number 15, without any necessary machining or other adjustments and since it is thin enough it would not upset any calibration of the carburetor or any of its workings. The plate, Number 11, could be placed between gaskets or tightened sufficiently to prevent any leakage. For some models of some manufacturers there are special base plates sitting under the carburetor, Number 10, which sit on the intake manifold, Number 12, and provide the necessary room for the carburetor to properly work. The openings from the carburetor to the intake manifold are matched by the openings in the plate, Numbers 16 and 17, which are of the same size and in the same place as corresponding openings in the carburetor and the intake manifold. The outside circumference of the opening in the plate, Number 19, is larger than the inner circumference formed by the points of the vanes, Numbers 20 and 29, causing a slight Venturi effect and the widening out for the balance of the depth of the plate opening at its exit side. The vanes, Number 21, are triangularly shaped with the base of the triangle, Number 18, against the outside circumference of the opening in the plate, Number 19. From this base on the long side of the triangular vane the side first rises in a small lip or shoulder, Number 22, and then dips down at a slight angle to the horizontal to the point of the vane, Number 26, toward the center of the opening in the plate. At the same time this side together with the other side of the triangular vane, Number 24, forms a convex surface in the shape of a cup or collector, Number 25, which directs and funnels any liquid mixture not vaporized by the turbulence caused by the slight shoulder or lip on the long side of the vanes to the points of the vanes, Number 26, toward the center of the opening in the plate which causes further atomization and vaporization of the remaining liquid mixture. Assuming the swirling mixture is moving in a counterclockwise direction as directed by the vanes, Number 21, the vanes would aid in breaking up and collecting any liquid for for further vaporization toward the center of the plate opening. In any event, the swirling mixture would strike the convex surfaces of the vanes, Number 25, and collect out liquid particules not sufficiently atomized for further action at the points of the vane collectors. The triangular vanes also catch any mixture sliding down the walls of the carburetor and direct them to the points of the vanes for further vaporization.

Figure 2:
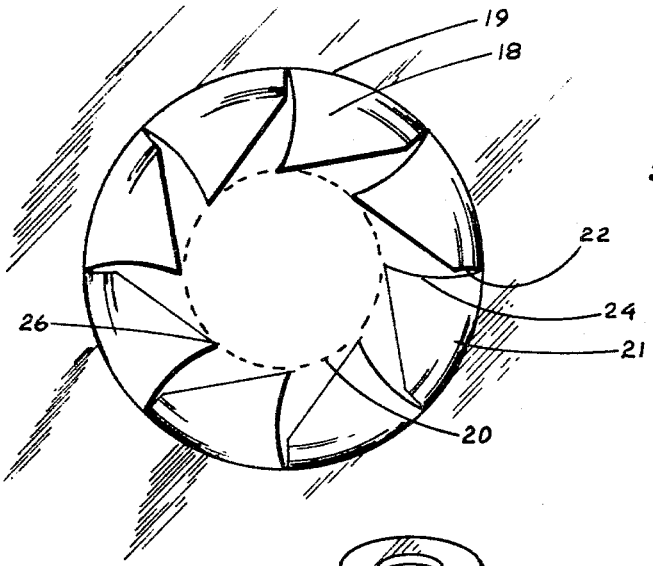
FIG. 2 is a top plan view of the opening in the plate showing the vanes as they appear therein.
Figure 3:
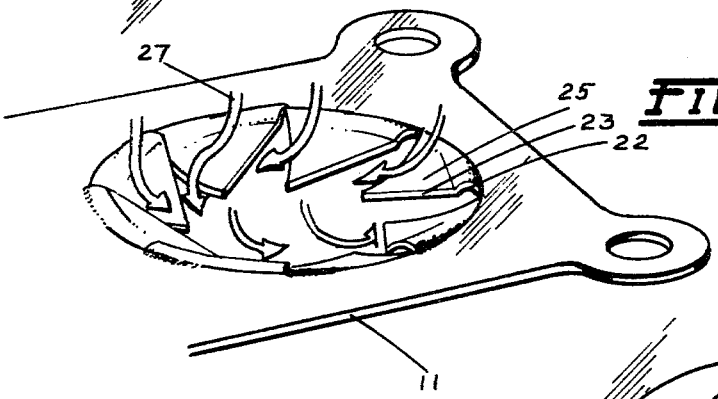
FIG. 3 is a partial isometric view of the plate showing the general configuration of the vanes with arrows showing the swirling direction of the mixture.
Figure 4:
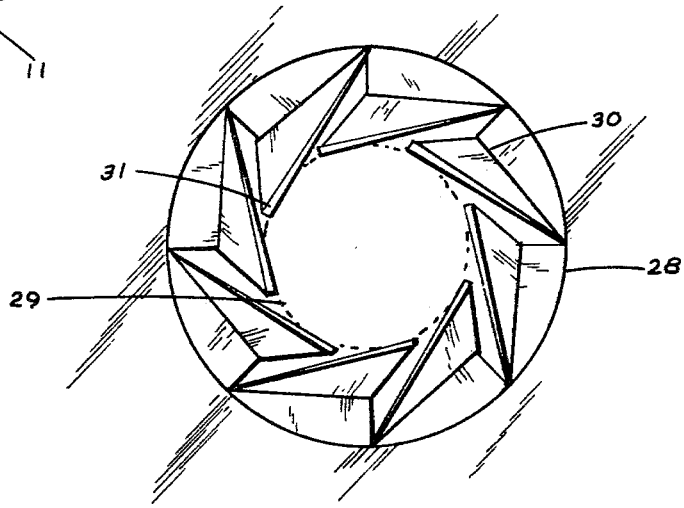
FIG. 4 is a top plan view of another type of vanes in the opening of the plate.
Figure 5:
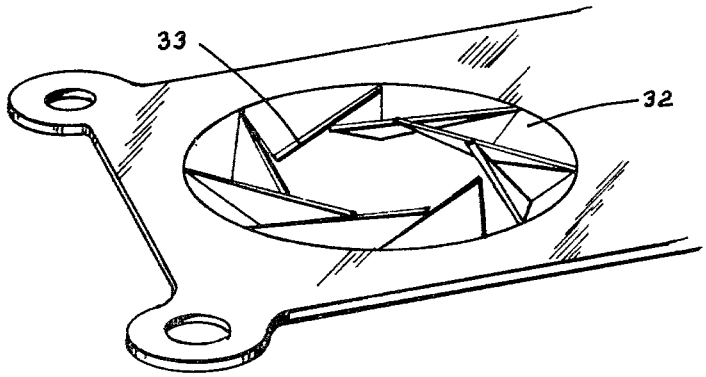
FIG. 5 is a partial isometric view of the plate with the vanes as shown in FIG. 4.

FIGS. 4 and 5 show another type of vane set in the plate opening formed from a triangular vane, Number 32, which itself is folded to form two triangles, Number 30, with the first triangular vane sloping down toward the crease, and the second sloping gently up to the point toward the center of the plate opening, Number 31. These triangles form collectors the same as FIGS. 2 and 3, with various points along the crease and along the edge toward the point in the center of the plate opening acting as collecting points or cups further promoting vaporization. One can see from the crease effect in FIG. 5 that the sloping edge of the crease would act as another collecting point, Number 30, besides that of the points, Number 31, sloping up and toward the center of the plate opening. The leading edges of these triangular vanes could also be wedge shaped thus also helping to promote turbulence and vaporization, Numbers 31 and 33.

It is expected that the plate would be made from some suitable metal not likely to deform at the temperature expected at that point and likely to keep its shape despite intense use. And that such plate would be thin enough not to require recalibration of the carburetor but thick enough to house the various type vanes proposed. Most probably such plates could easily be stamped out thus decreasing the costs and since installation would be simple and there is no moving parts to be adjusted replacements for various causes could be just as simple. Various types of different bases, baffles and gaskets would have to be used depending on the manufacture but these could be individually made or set up in kits depending on what company manufactured the vehicle.

Several test runs has been made with vehicles with the device installed and gas mileage has shown an appreciable gain per gallon. One of these vehicles was a truck.

While the invention has been described in conjunction with specific embodiments, there are many alternatives, modifications and variations that will be apparent to those skilled in the art in light of the foregoing description. Accordingly, it is intended to embrace all such alternatives, modifications and variations as fall within the spirit and broad scope of the appended claims. It is also intended to embrace all equivalents and substitutes within the broad scope of this invention.

I claim:

1. Apparatus inserted between the bottom of a carburetor and the top of the intake manifold of the internal combustion engine using gasoline, helping to further atomize and vaporize the fuel mixture, which apparatus comprises:

(a) a plate that fits between the carburetor and and the intake manifold fastened to both, and (b) openings in the plate coinciding with similarly placed openings from the carburetor and openings leading to the intake manifold;

(c) with a plurality of triangularly convex shaped funnel like vanes acting as liquid fuel collectors set in the openings of the plate with the bases of the vanes contiguous to another forming the outer circumference of the plate opening, then, gently sloping down into the openings and toward their centers, forming an inner circumference at the points of the vanes smaller in size than the outer circumference, and (d) with each of the vanes slanted in a counterclockwise direction with the larger side of the vanes at the outer circumference first forming a slightly raised shoulder and then dropping gently toward the center of the opening forming a cup shaped convex curved surface, curving in toward the center of the opening, meeting the other side of the vane also similarly curved at the apex of the vanes funneling liquid fuel particles to the center of the openings; and (e) which vanes cause the fuel mixture to swirl with greater turbulence, collecting any liquid fuel particles into the center of the air stream, generating greater vaporization with a continuing pattern of atomization and vaporization.

2. The claim as recited in claim 1, in which the vanes further comprises:

(a) two oppositely sloping traingular funnel like vanes, the first sloping gently down from the outer circumference of the openings, and (b) the second vane gently sloping up from the first part and forming a funnel directing the mixture to the center of the opening.

3. The claim as recited in claim 1, in which the plate further comprises a comparatively thin thickness not interfering with the usual workings of the carburetor.

4. The claim as recited in claim 1, in which the circumference of the openings at the apexes of the vanes further comprises a diameter of not less than three-quarters of an inch.

* * * * *